US009303931B2

(12) United States Patent
Jensen

(10) Patent No.: US 9,303,931 B2
(45) Date of Patent: Apr. 5, 2016

(54) FIREARM OPERATING SYSTEM

(71) Applicant: Neil Jensen, Fargo, ND (US)

(72) Inventor: Neil Jensen, Fargo, ND (US)

( * ) Notice: Subject to any disclaimer, the term of this patent is extended or adjusted under 35 U.S.C. 154(b) by 156 days.

(21) Appl. No.: 13/657,890

(22) Filed: Oct. 23, 2012

(65) Prior Publication Data

US 2014/0144314 A1 May 29, 2014

(51) Int. Cl.
*F41A 5/24* (2006.01)
*F41A 3/64* (2006.01)

(52) U.S. Cl.
CPC .... *F41A 3/64* (2013.01); *F41A 5/24* (2013.01)

(58) Field of Classification Search
CPC ..... F41A 3/78; F41A 5/00; F41A 5/18; F41A 5/24; F41A 5/26; F41A 5/28; F41A 5/30
USPC ..... 42/16; 89/193, 191.01, 194, 129.01, 26, 89/191.02
See application file for complete search history.

(56) References Cited

U.S. PATENT DOCUMENTS

| | | | | | |
|---|---|---|---|---|---|
| 2,951,424 | A * | 9/1960 | Stoner | 89/179 |
| 3,045,555 | A * | 7/1962 | Stoner | 89/142 |
| 5,272,956 | A * | 12/1993 | Hudson | 89/128 |
| 5,351,598 | A * | 10/1994 | Schuetz | 89/185 |
| 5,499,569 | A * | 3/1996 | Schuetz | 89/197 |
| 5,520,019 | A * | 5/1996 | Schuetz | 42/49.02 |
| 6,609,319 | B1 * | 8/2003 | Olson | 42/16 |
| 6,971,202 | B2 | 12/2005 | Bender | |
| 7,137,217 | B2 | 11/2006 | Olson et al. | |
| 7,275,472 | B1 * | 10/2007 | Finn | 89/26 |
| 7,444,775 | B1 * | 11/2008 | Schuetz | 42/76.01 |
| 8,393,103 | B2 * | 3/2013 | Brown | 42/16 |
| 8,695,260 | B2 * | 4/2014 | Kramer | 42/69.02 |
| 2011/0005383 | A1 * | 1/2011 | Kramer | 89/191.01 |
| 2011/0209377 | A1 * | 9/2011 | Davies | 42/16 |
| 2011/0271827 | A1 * | 11/2011 | Larson et al. | 89/193 |
| 2012/0055058 | A1 * | 3/2012 | Picard et al. | 42/16 |
| 2012/0137872 | A1 * | 6/2012 | Crommett | 89/193 |
| 2012/0152106 | A1 * | 6/2012 | Langevin | 89/193 |
| 2012/0180648 | A1 * | 7/2012 | Sullivan et al. | 89/193 |
| 2013/0269510 | A1 * | 10/2013 | Sullivan | 89/193 |
| 2013/0276624 | A1 * | 10/2013 | Crommett | 89/193 |
| 2014/0076144 | A1 * | 3/2014 | Gomez | 89/132 |

FOREIGN PATENT DOCUMENTS

WO WO 2012137132 A1 * 10/2012

* cited by examiner

*Primary Examiner* — Jonathan C Weber

(57) ABSTRACT

A firearm operating system for self-loading firearms includes a bolt body having a forward bolt bearing, a piston and an aft bolt bearing arranged around the bolt body; a bolt carrier slidingly receiving the bolt body in a longitudinally-oriented cylinder, the cylinder extending from a forward end of the bolt carrier into the bolt carrier a predetermined distance, the bolt carrier having a tubular aft carrier bearing, wherein the bolt is slidingly captured in the cylinder of the bolt carrier and borne on the two bearings of the bolt body, wherein the forward bearing of the bolt body is borne on the cylinder of the bolt carrier, wherein the aft bearing of the bolt body is borne on the aft bolt carrier bearing, wherein a gap is formed between the piston and the cylinder, and wherein the piston and the cylinder do not contact each other.

20 Claims, 10 Drawing Sheets

FIREARM OPERATING SYSTEM

FIELD OF INVENTION

The present invention relates to operating systems for self-loading firearms, including automatic and semiautomatic operating systems. More particularly, the present invention relates to an operating system which is highly dependable and highly consistent from shot-to-shot and which exhibits predictable performance and accuracy to a degree heretofore unknown in self-loading firearms.

BACKGROUND INFORMATION

Both military and civilian shooters use and rely on self-loading firearms in virtually every known shooting discipline, including tactical operations, sniping, all types of competitions, plinking and hunting. The actions and other components have evolved and improved in many ways through the years, with numerous refinements in barrels, bullet design, propellants and other features. The result is that self-loading firearms are more accurate and more reliable than ever before. However, there is still plenty of room for improvement.

SUMMARY OF THE INVENTION

The present invention provides a firearm operating system for self-loading firearms comprising a generally cylindrical bolt body and a bolt carrier component slidingly receiving the bolt body in a longitudinally-oriented cylinder in the bolt carrier, wherein drag from the piston/cylinder interface is eliminated. The elimination of the drag between the piston and the cylinder supports the smooth and predictable cycling of the operating system and avoids the introduction of non-uniform impulses, vibrations and harmonics during the firing process. This in turn promotes significantly improved accuracy.

In accordance with a first embodiment of the invention, a firearm operating system for self-loading firearms includes a generally cylindrical bolt body inside a bolt carrier, including a forward bearing arranged around the bolt body aft of the bolt head;

a piston portion arranged around the bolt body aft of the forward bearing;

an aft bolt bearing arranged around the bolt body aft of the piston portion and at an aft end of the bolt body;

wherein the bolt carrier slidingly receives the bolt body in a longitudinally-oriented cylinder in the bolt carrier, the cylinder extending from a forward end of the bolt carrier into the bolt carrier a predetermined distance;

a gas port on the exterior of the bolt carrier and in fluid communication with the cylinder interior to the bolt carrier through a wall of the bolt carrier;

a tubular aft carrier bearing section oriented longitudinally in the bolt carrier and extending from an aft end of the bolt carrier a predetermined distance into the bolt carrier to a point of communication with the cylinder, wherein the bolt body is slidingly captured in the cylinder of the bolt carrier and borne on the two bearings of the bolt body, wherein the forward bearing of the bolt body is borne on the cylinder of the bolt carrier, wherein the aft bearing of the bolt body is borne on the aft carrier bearing of the bolt carrier, wherein the piston portion of the bolt coacts with the cylinder of the bolt carrier to form a vented chamber which is in gas communication with the gas port, wherein a gap is formed between the piston portion and the cylinder, wherein the piston and the cylinder do not contact, and wherein upon a sufficient amount of gas being delivered into the vented chamber to fully cycle the bolt and bolt carrier, drag at the piston/cylinder interface is eliminated.

The elimination of all drag and friction at the piston/cylinder interface significantly improves the repeatable functioning of the operating system. In turn, this leads to improved accuracy for the firearm.

In accordance with a variation of the first embodiment, a firearm operating system for self-loading firearms, e.g., firearms operating on the direct-impingement gas operating principle, includes a generally cylindrical bolt body having a bolt head at a forward end of the bolt body, a forward bearing arranged around the bolt body aft of the bolt head, a piston portion arranged around the bolt body aft of the forward bearing, an aft bolt bearing arranged around the bolt body aft of the piston portion and at an aft end of the bolt body; and a bolt carrier component slidingly receiving the bolt body in a longitudinally-oriented cylinder in the bolt carrier, the cylinder extending from a forward end of the bolt carrier into the bolt carrier a predetermined distance, a tubular aft carrier bearing section oriented longitudinally in the bolt carrier and extending from an aft end of the bolt carrier a predetermined distance into the bolt carrier to a point of communication with the cylinder, wherein the bolt body is slidingly captured in the cylinder of the bolt carrier and borne on the two bearings of the bolt body, wherein the forward bearing of the bolt body is borne on the cylinder of the bolt carrier, wherein the aft bearing of the bolt body is borne on the aft carrier bearing of the bolt carrier, wherein the piston portion of the bolt coacts with the cylinder of the bolt carrier to form a gas chamber which is in gas communication with a gas port, wherein a gap is formed between the piston portion and the cylinder, wherein the piston and the cylinder do not contact, and wherein a sufficient amount of gas delivered into the chamber will fully cycle the bolt and bolt carrier and the operating system. According to the inventive embodiment, drag from the piston/cylinder interface is eliminated.

The drag between the gas rings of the bolt and bolt carrier in prior art systems is attributed with the creation of undesirable and unpredictable vibration and harmonics irregularities. In turn these irregularities lead to vertical stringing of bullets with regard to the desired point of impact, degrading accuracy to an unacceptable degree.

In accordance with the known prior art arrangements of direct-impingement operating systems for firearms, e.g., M-16, AR-15, M-110, AR-10, LR308 and SR25 firearms, the bolt body includes a bolt head at a forward end of the bolt body, and the bolt head includes a plurality of locking lugs arranged around the bolt head. The bolt head generally includes a bolt face surrounded by the locking lugs and oriented perpendicularly to a longitudinal axis of the bolt, the bolt face having a firing pin hole, a cartridge extractor and a cartridge ejector, and a firing pin bore arranged longitudinally through the center of the bolt body, extending from the aft bolt body to the firing pin hole in the bolt face. The firing pin bore extends through every element that extends through the longitudinal axis, including a cam pin, which is described in more detail below.

The bolt carrier, as is known in the art, includes a gas port on the exterior of the bolt carrier, and in gas/fluid communication with the cylinder which is interior to the bolt carrier through a wall of the bolt carrier. The gas port may be in gas/fluid communication with a gas key, which in turn is in gas/fluid communication with a gas tube which delivers high-pressure gas from the firearm's barrel.

As described above, the bolt body may be captured in the bolt carrier by a cam pin which extends through a cam slot in the wall of the bolt carrier and into the bolt body. The cam pin may include a firing pin hole through a terminal end, which extends through the longitudinal axis of the bolt, and the cam pin may include a cam head at a distal end which is in a cooperative relationship with a slot in a receiver of the firearm, said receiver providing a functional mounting arrangement for many of the parts of the firearm, e.g., the bolt/bolt carrier assembly, barrel, gas system, etc.

In accordance with a first variation of the firearm operating system, the bolt carrier may be slidingly mounted in a firearm receiver. In particular, the bolt carrier may be slidingly mounted in an upper firearm receiver. This arrangement provides the advantage of being easily retrofitted to properly function with hundreds of thousands of existing firearms. In accordance with a further variation of the firearm operating system, the gap between the piston and the cylinder is about 1 ten thousandth of an inch (0.00254 mm). Other gap sizes include about 1 thousandth of an inch (0.0254 mm), and ranges of 1-5 ten thousandth of an inch (0.00254 mm-0.0127 mm), 5-10 ten thousandths (0.0127 mm-0.0254 mm), 1-3 thousandths (0.0254 mm-0.0762 mm), 3-5 thousandths (0.0762 mm-0.127 mm), 1-5 thousandths (0.0254 mm-0.127 mm), 5-10 thousandths (0.127 mm-0.254 mm), and 10-15 thousandths (0.254 mm-0.381 mm) and 15-20 thousandths (0.381 mm-0.508 mm).

Advantageously, the gap size may virtually any size which permits proper functioning without contact between the piston and the cylinder. The gap size which is appropriate for a particular firearm may depend on a number of factors, including the amount and rate of gas delivered from the gas system into the gas chamber, the type and amount of gunpowder used, the mass and style of the bullet, the mass of the bolt/bolt carrier assembly, the spring rate of the buffer spring and other factors. This gap size and the gap sizes described herein would be found when the bolt is fully in battery and when the bolt lugs of the bolt head are fully engaged with the corresponding lugs of the barrel or barrel extension. The firearm is considered to be out-of-battery when the operating system is not fully positioned for firing.

In accordance with another variation of the firearm operating system, the forward bearing of the bolt body may be a continuous ring arranged generally perpendicular to the longitudinal axis of the bolt. Alternatively, the forward bearing of the bolt body may be a segmented ring arranged generally perpendicular to the longitudinal axis of the bolt. These different arrangements offer a balance of maximum bearing support versus reduced drag, for smoother bolt/bolt carrier operation. The forward bearing of the bolt bears directly on the cylinder of the bolt carrier, and the forward bearing or its segments may be made in various widths to satisfy these competing considerations.

In accordance with a further variation of the firearm operating system, the aft bearing of the bolt body is a cylindrical tube.

In accordance with another variation of the firearm operating system, upon the introduction of gas, i.e., high pressure gas, into the gas chamber, the piston and the cylinder are urged to move relative to each other wherein the chamber is expanded and the piston is displaced to a position adjacent a gas release port in the wall of the bolt carrier wherein the gas is released.

In accordance with a further variation of the firearm operating system, the cam head is captured in a substantially straight slot in an upper receiver.

In accordance the operating principles of common direct-impingement-operated firearms, after a cartridge in the chamber is fired high-pressure gas propels a bullet down the barrel, and a portion of the gas is re-directed by the gas system toward the operating system. In response to gas pressure, i.e., high pressure gas, introduced into the gas chamber between the piston and the cylinder via the direct impingement gas system, sequentially, the bolt carrier is displaced relative to the bolt to enlarge the gas chamber, the cam slot in the wall of the moving bolt carrier acts on the cam pin which rotates the bolt slightly according to the cam slot, wherein the bolt lugs are unlocked from the barrel/barrel extension, wherein the firearm is now out-of-battery, and the bolt is pulled away from the barrel and its chamber by the motion and mass of the bolt carrier assembly. Applicant seems to be at odds with others in the field regarding the actual timing of the operating system. There are those who believe that a fired bullet has exited from the barrel long before it is possible for any gas pressure to start through the operating system. On the other hand, the evidence and observations presented herein supports the view that the gas pressure starts to cycle the operating system as soon as the fired bullet passes the gas port in the barrel. It is clear that the dynamic system is very complex and that a number of different events are occurring simultaneously or in very close succession.

In accordance with another variation of the firearm operating system, the forward bearing and the aft bearing of the bolt body engage the corresponding bearing portions of the bolt carrier in a sliding fit without discernible axial play. In accordance with a further variation of the firearm operating system, the axial play is less than a half of a thousandth of an inch. This arrangement provides the radial stability necessary for maximum accuracy and minimizes the possibility of the bolt binding within the bolt carrier.

In accordance with a further variation of the firearm operating system, the fore and aft reciprocating motion of the bolt body in the carrier on their respective bearings prevents significant accumulation of fouling on the bearing surfaces. This provides the advantage a more uniform and predictable function of the operating system, which promotes superior accuracy.

In accordance with another variation of the firearm operating system, wherein the cylinder of the bolt carrier includes a straight, non-tapered section, wherein the gap between the piston and the cylinder is generally uniform as the gas chamber expands. This arrangement provides the advantage of a frictionless, but predictable piston/cylinder interface which is consistent through the functional range of the operating system.

In accordance with a further variation of the firearm operating system, the cylinder includes a tapered frusto-conical shape, wherein the gap between the piston cup and the cylinder is enlarged as the gas chamber expands. This arrangement provides the advantage of a frictionless, but predictably variable piston/cylinder interface which permits the high-pressure gas to be released more quickly past the piston and towards the exhaust port in the bolt carrier.

In accordance with another variation of the firearm operating system, the cylinder includes one of a parabolic tapered shape and an elliptical tapered shape, wherein the tapered portion of the cylinder is between the aft bearing of the bolt carrier and the gas port of the bolt carrier. This arrangement provides the advantage of a frictionless, but predictably variable piston/cylinder interface which permits the high-pressure gas to be released in a non-linear manner, wherein the high-pressure gas may be released very quickly.

Such arrangements permit a gas system to be tailored to the unique gas-pressure profiles of an almost limitless combination of cartridges/chamberings/calibers, bullet weights, propellant types and weights, muzzle velocities, barrel lengths, gas port positions, etc. . . . , all while promoting maximum accuracy and predictability of the operating system.

Figure 1:
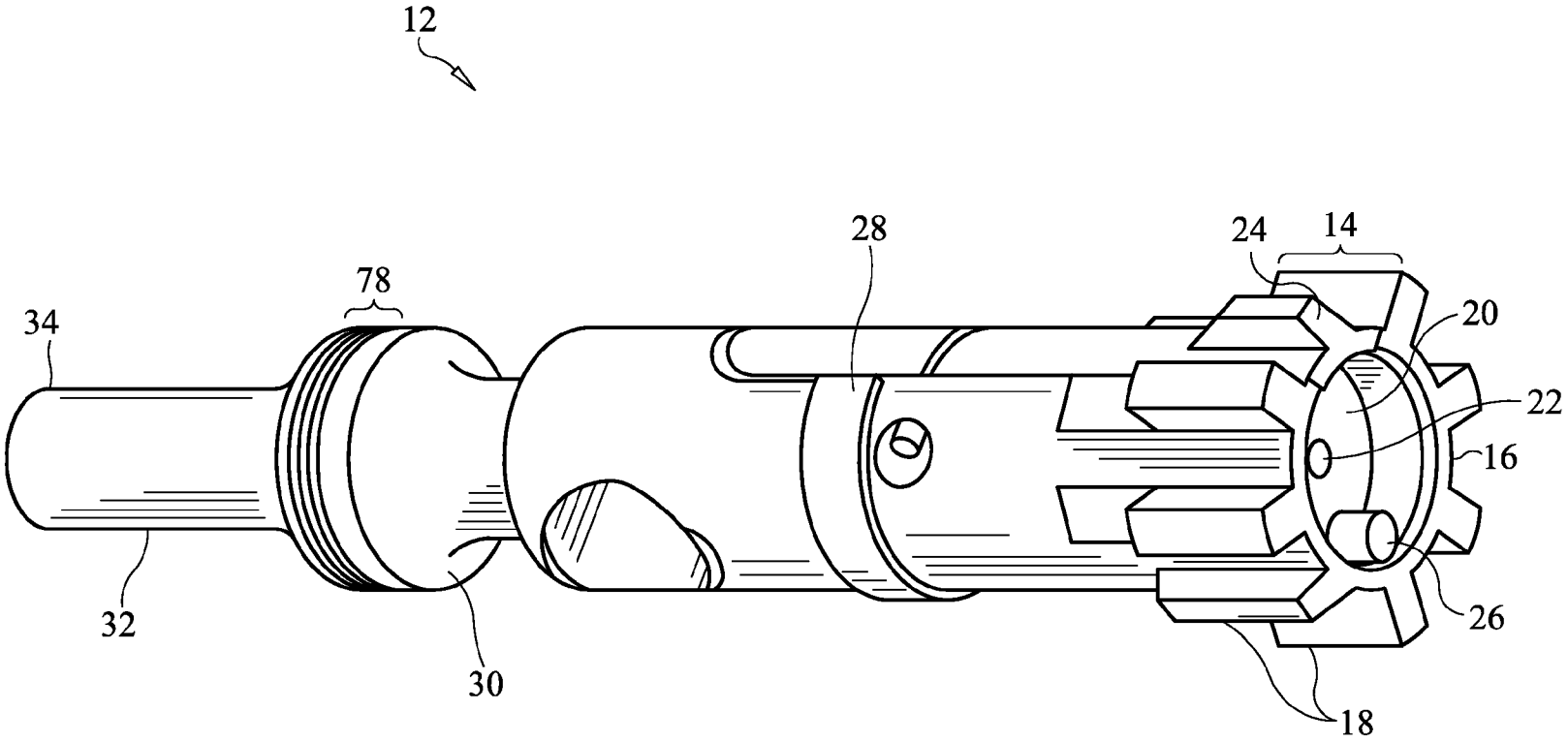
FIG. 1 PRIOR ART
FIG. 1 illustrates a perspective view of a prior art firearm bolt assembly.
Figure 2:
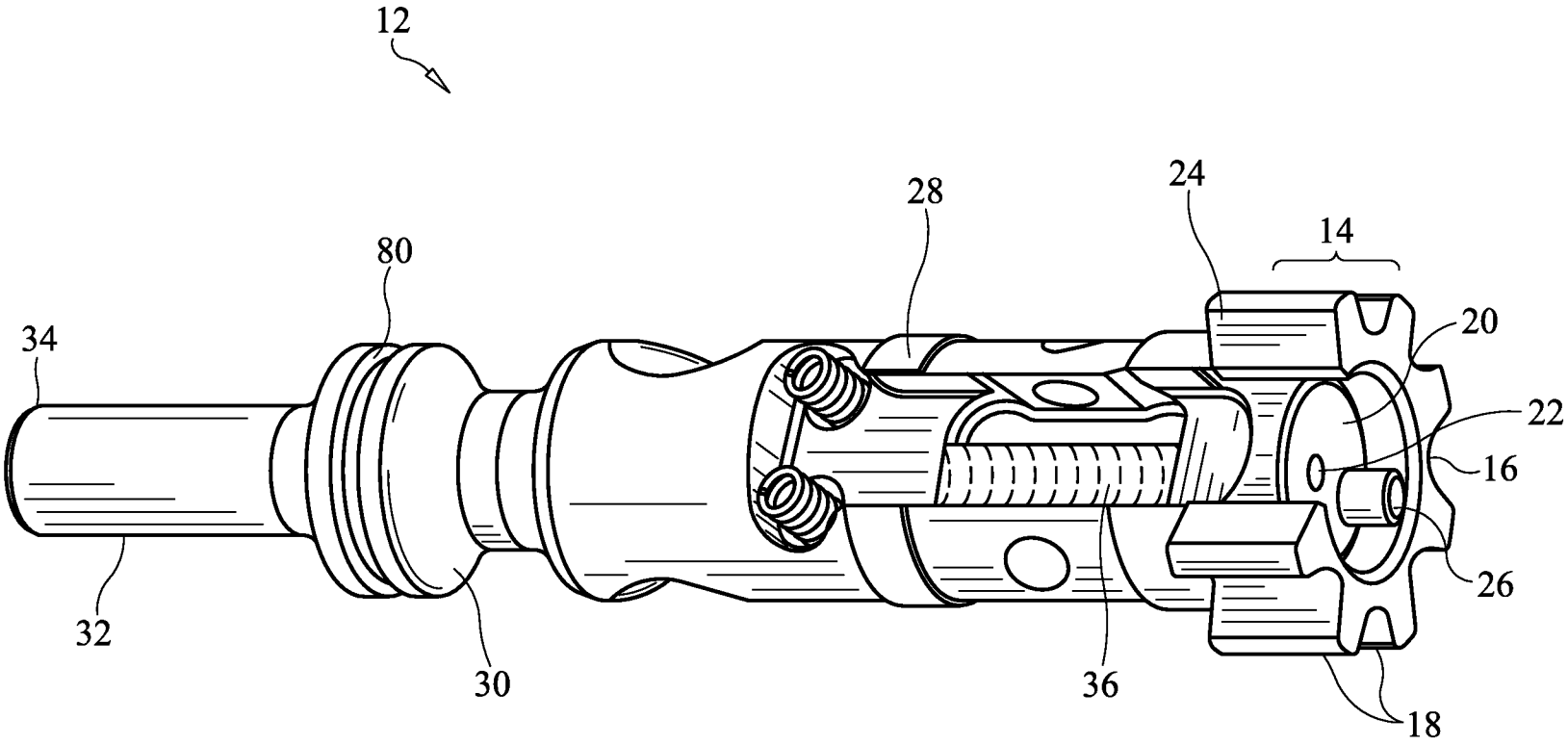
FIG. 2 PRIOR ART
FIG. 2 illustrates a perspective view of a prior art firearm bolt with extractor and gas controls rings removed.
Figure 3:
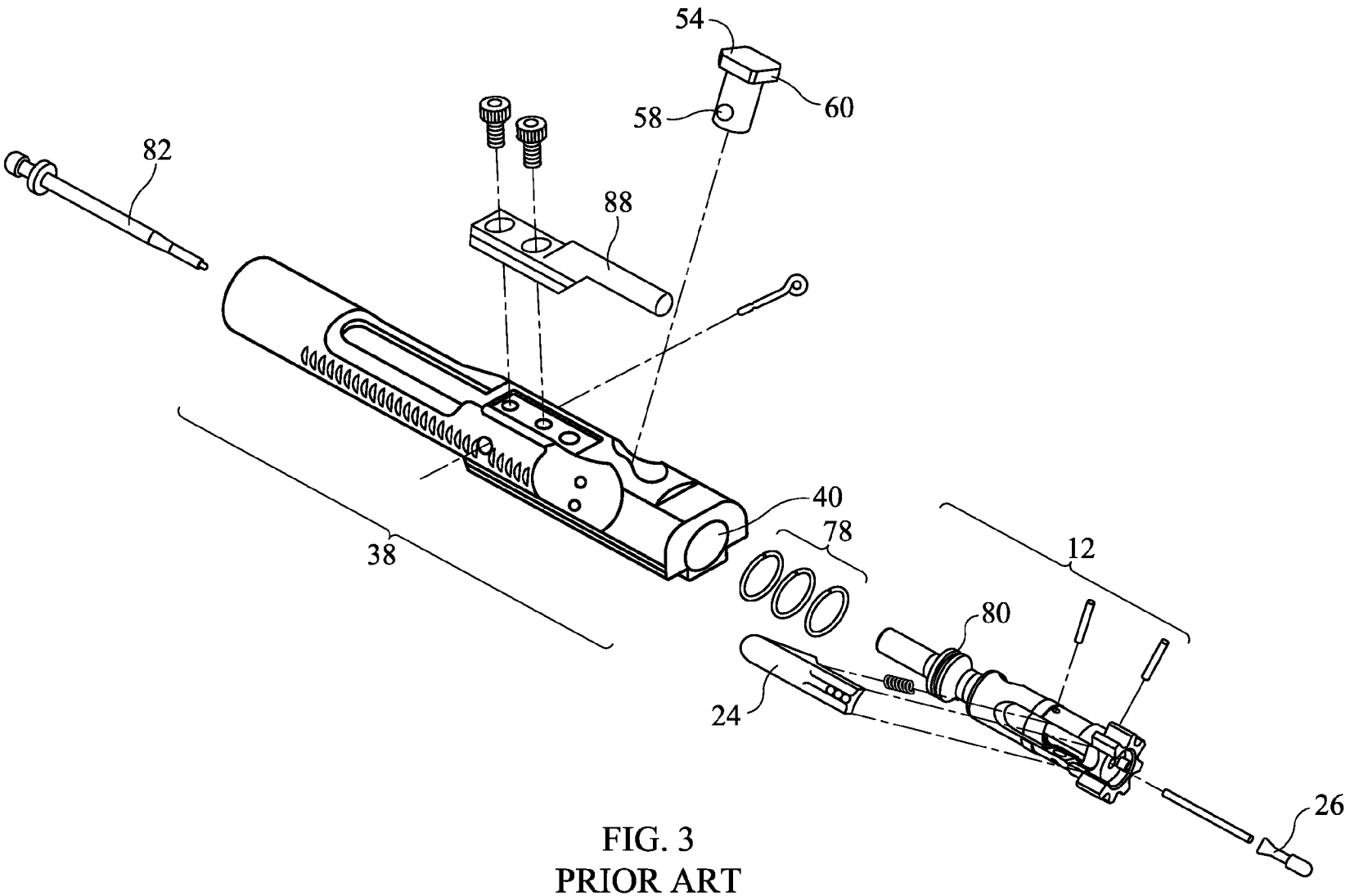
FIG. 3 PRIOR ART
FIG. 3 illustrates an exploded view of a prior art firearm bolt carrier.
Figure 4:
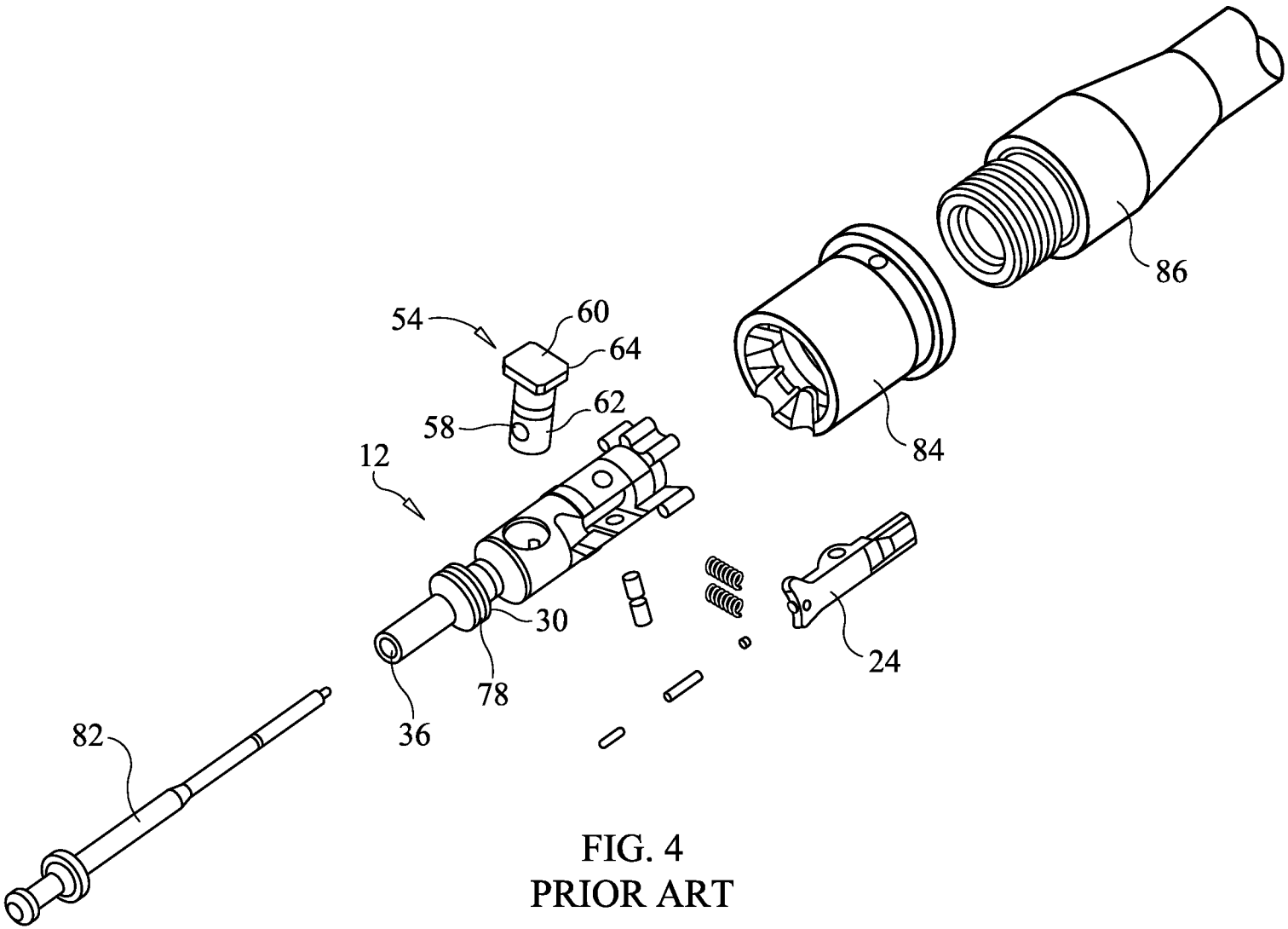
FIG. 4 PRIOR ART
FIG. 4 illustrates an exploded view of a prior art firearm bolt and barrel/barrel extension.
Figure 5:
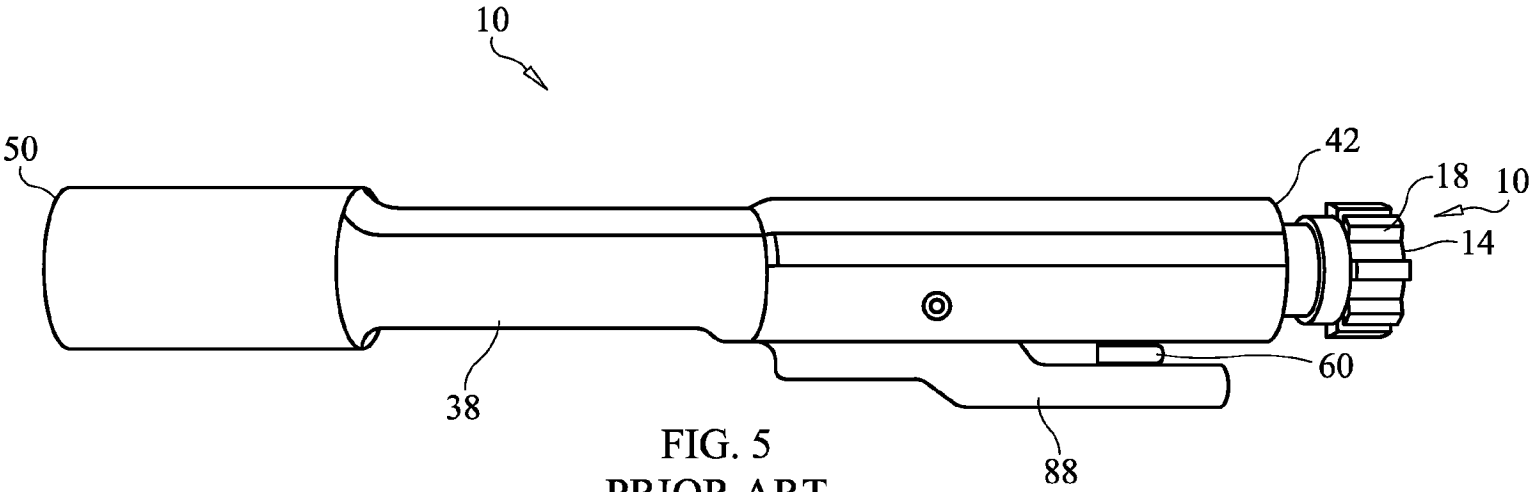
FIG. 5 PRIOR ART
FIG. 5 illustrates a side view of a typical bolt carrier assembly.
Figure 6:
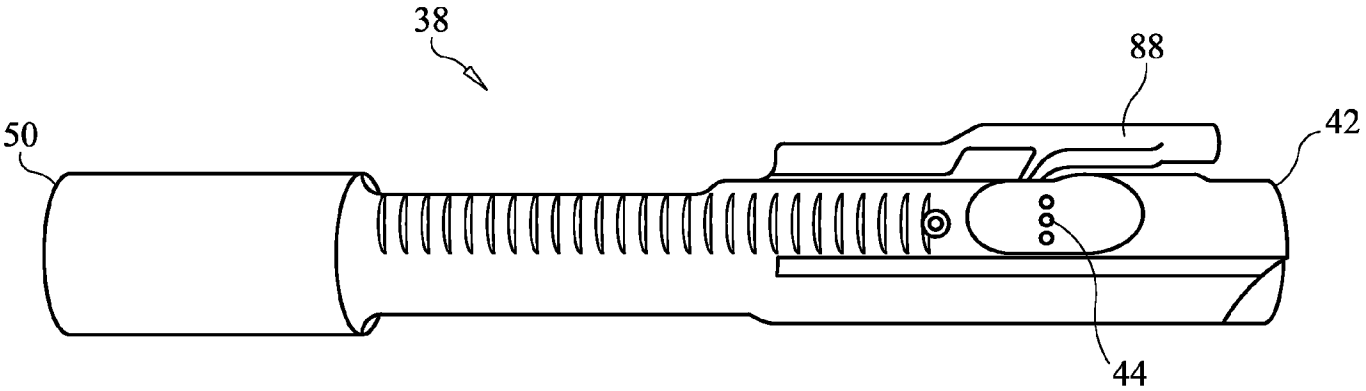
FIG. 6 illustrates a side view of a bolt carrier minus the bolt assembly.
Figure 7:
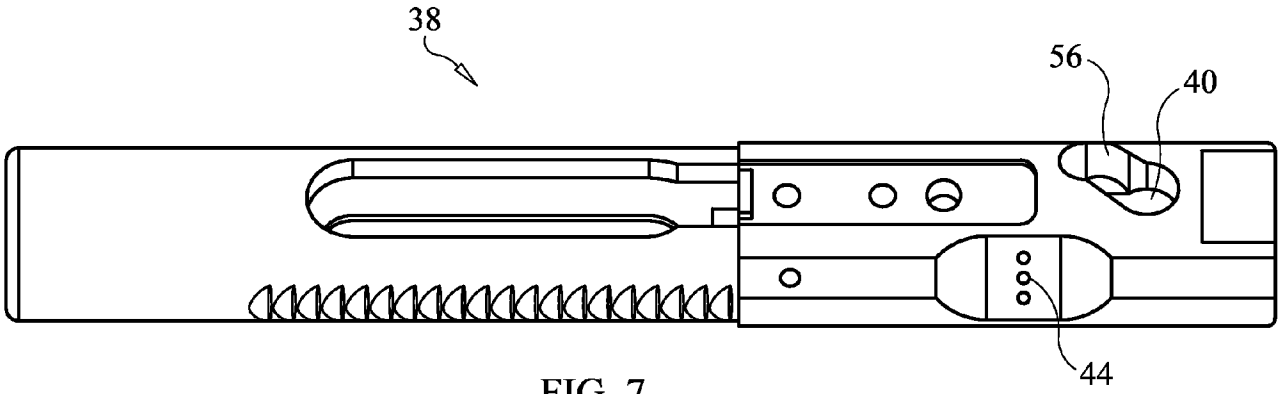
FIG. 7 PRIOR ART
FIG. 7 illustrates a side view of a stripped bolt carrier.
Figure 8:
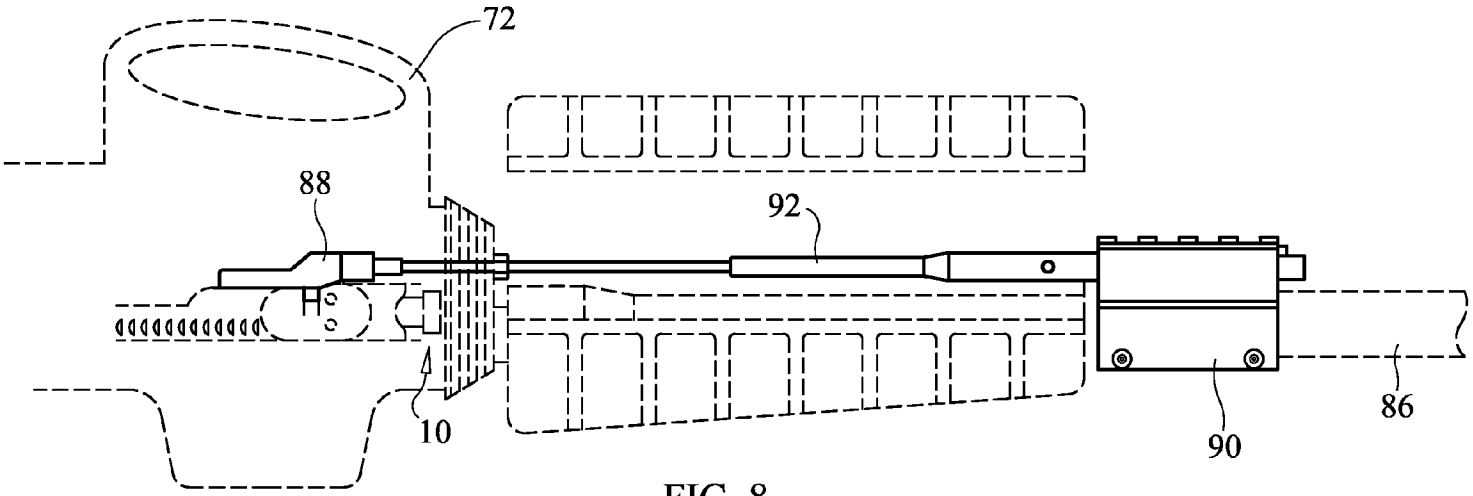
FIG. 8 PRIOR ART
FIG. 8 illustrates a side view of a typical upper receiver assembly.
Figure 9A:
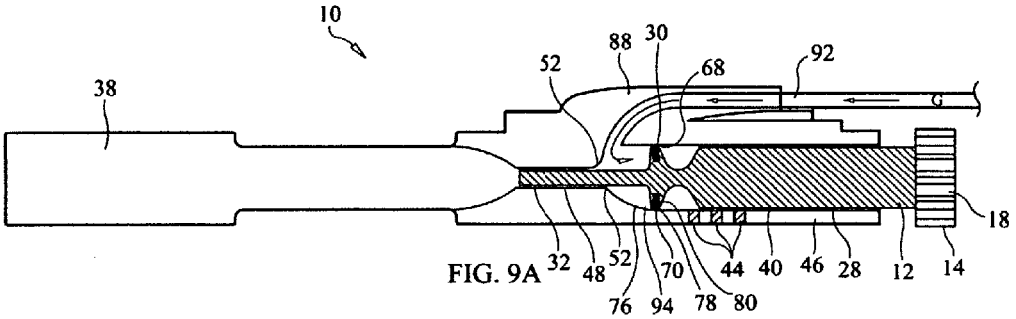
FIGS. 9A-9B illustrate sectional views of a firearm bolt and bolt carrier in a battery orientation and out of battery, respectively, according to the prior art.
Figure 9B:
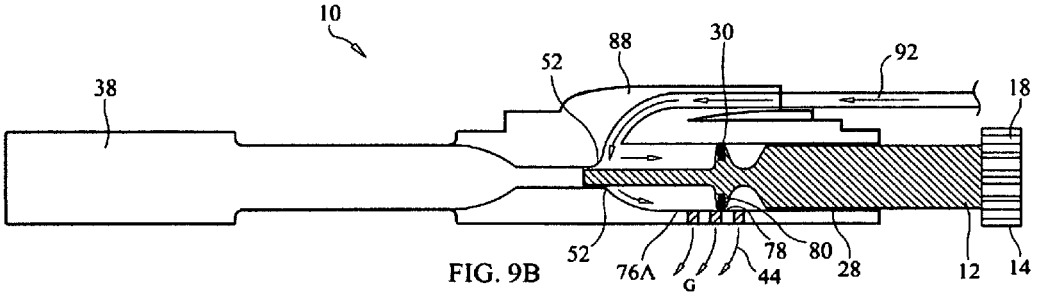
FIG. 9B (Prior Art)

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE EMBODIMENTS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Furthermore, there is no intention to be bound by any expressed or implied theory presented in the preceding technical field, background, brief summary or the following detailed description.

The present invention is directed to a firearm operating system for a self-loading firearm, in particular a gas-operated operating system based on the direct impingement operating principle. A goal of the present invention is eliminate the erratic and unpredictable cycling of the operating system which negatively affects accuracy to a degree that is noticeable at longer ranges.

FIGS. 1-9B illustrate typical components and arrangements for self-loading firearms' operating systems. A bolt carrier assembly 10 includes a bolt body 12 at a forward end 16 of the bolt body, and a bolt head 14 at the forward end 16 as well. The bolt head 14 includes a number of locking lugs 18 around a bolt face 20, with a firing pin hole 22, extractor 24 and ejector 26 in or around the bolt face 20.

The bolt body 12 includes a forward bolt bearing 28, a piston section 30, and an aft bolt bearing 32, wherein the aft bolt bearing is situated near an aft end 34 of the bolt body 12. A firing pin bore 36 is situated through the bolt body 12, extended between the aft end 34 and the firing pin hole 22 in the bolt face 20.

The prior art bolt carrier assembly 10 includes a bolt carrier 38 which includes a cylinder 40 which is generally of uniform diameter. The cylinder 40 of the forward end 42 of the carrier 38 provides a bearing surface to complement the forward bolt bearing 28.

One or more gas ports 44 are located in the wall 46 of the carrier 38 and extend into the cylinder 40 to vent gunpowder combustion gases away from the internal mechanism of the operating system and trigger (not shown). A tubular aft carrier bearing 48 is located near the aft end 50 of the carrier 38 and complements the aft bolt bearing 32 of the bolt body 12.

A point of communication 52 is located inside the carrier 38 at the internal transition between the cylinder 40 and the aft carrier bearing 48. A cam pin 54 extends through a cam slot 56 in the carrier 38 into the bolt body 12. The cam pin 54 includes a firing pin cam bore 58 for capturing a firing pin 82 therethrough. The cam pin 54 includes a cam head 60 at a distal end 64, and the firing pin cam bore 58 at a terminal end 62.

A sealed gas chamber 94 (see FIG. 9A) is formed in the cylinder 40 between the piston 30 of the bolt body 12 and the point of communication 52. The sealed gas chamber 94 is sealed because the high-pressure gases G from the combustion of gunpowder have nowhere to directly exit the sealed gas chamber 94. The carrier 38 must be moved relative to the piston 30 of the bolt 12 (see FIG. 9B) in order to release the gases G. The piston 30 is sealed against the cylinder 40 with one or more gas rings 78 which are captured in a gas ring groove 80 around the piston 30. The high-pressure gases G are introduced into the sealed gas chamber 94 by way of the barrel 86, the gas block 90 (adjustable or fixed) on the barrel's gas port (not shown), through the gas tube 92, and into the gas tap 88 atop the carrier 38. The gas tap 88 continues the gas conduit directly into the cylinder 40.

The cycling of the operating system is intended to encompass, individually and collectively, the locking of the bolt 12 into battery, the unlocking of the bolt 12 due to gas impingement from the gas system, the ejection of the spent cartridge, and the return of the bolt 12 to battery. The Stoner-type system this operating system is based on relies upon a bolt carrier 38 to moveably capture the bolt 12 in a manner wherein the carrier 38 is capable of responding to the gas impingement of the gas system and to cycle the bolt 12 into and out of battery. Such operating systems are found in a wide variety of self-loading firearms, such as the M-16 and its numerous variants, the AR-10 and its numerous variants, and the M-110 rifle, to name a few. Regardless of their nomenclature or trade names, these firearms each operate according to the same principles. They also have the same problems.

It was noticed that various firearms which operate according to the direct gas-impingement operating system were incapable of maintaining the fired bullets within 1 moa (minute of angle), particularly at 300 yards (274 meters) and beyond. In particular, a vertical stringing behavior for some bulets was noticed. These effects were particularly noticeable at 600 yards (549 meters) and 1000 yards (914 meters). The firearms exhibiting these characteristics included both AR-10/SR-25/LR308 and M-16/AR-15-type firearms in .223 Remington, .308 Winchester, 6 mm OMC and 6.5 Creedmoor chamberings. Each firearm was a dedicated competition rifle with high-quality components, such as Krieger barrels, match sights and triggers.

The shooter/inventor is a highly-experienced military and civilian competitor with an NRA (National Rifle Association) High Master classification, and with over three decades of national-level experience. The ammunition was dedicated for competition, and custom-built to exacting standards, to include neck-turning to a degree appropriate for consistent, and reliable bullet release, case-weighing to ensure maximum uniformity of cases, and each powder charge was weighed to within a fraction of a grain (by weight). Primers were carefully matched to the powder charge and bullet weight to provide maximum uniformity for a selected velocity, as determined by a chronograph.

Despite these efforts, and scores of 790+ out of 800 possible points, which are clearly remarkable shooting performances, invariably a few shots would exhibit the vertical stringing behavior. That is, a few shots would impact the paper target high, significantly outside the expected margin, but not dispersed horizontally as would be the case for wind drift. As is the case for the best shooters, the shooter engages in a self-critique process after each shot, to objectively determine where the shot should impact the target based on the shooter's image through the sights at the moment the trigger broke and the hammer/striker was released. Any misalignment of the sights or movement is noted and factored into the shooter's self-assessment before the shooter should view the bullet hole on the target. According to this procedure, the objective shooter can determine not only his personal performance, but also the performance and accuracy potential of the firearm.

Over and over again the shooter determined that no undesirable sight alignment or movement had taken place, but a few shots would be a little high or low by about 3 moa (minutes of angle).

The 600-yard target used in these competitions is identified as the MR-1 target, according to NRA standards. Such a target has a 6-inch (15.24 cm) X-ring (approximately 1 moa), a 12-inch (30.5 cm) 10-ring (approx. 2 moa), an 18-inch (45.7 cm) 9-ring (approx. 3 moa), and 8-ring through 5-rings which are successively larger. Clearly, a shot that is displaced vertically to the degree experienced is outside of the 10-ring, which costs the shooter valuable points. At the highest levels of competition, these vertical 'fliers' (unexplained deviant shots) can cost a match victory. Bolt-action firearms have traditionally dominated at long-range, due to the simple arrangement of components, and few moving parts. However, self-loading firearms are gaining a large following due to their advantages at shorter-range and rapid-fire events.

Known firearms which are built to operate according to a direct-impingement gas system all include a piston having a number of gas control rings (gas rings) 78. The gas rings 78 act as springs, like the piston rings of an internal combustion reciprocating piston engine, and they control the flow of gas G through the operating system and prevent the flow of gas G to the surrounding parts. However, the gas rings 78 are a third point of contact between the cylinder portion 40 of the bolt carrier 38, which adds a lot of friction to the gas operating system for the purpose of gas G control and system reliability. As a result of the extremely hot and dirty gas G through the gas system, the gas rings 78 become fouled with the byproducts of gunpowder combustion and lubricants after only a few shots. Once fouled, the friction characteristics of the gas rings 78 and the cylinder 40 change dramatically, for the worse, as the gas rings 78 become somewhat stuck in the accumulated fouling.

Temporary relief may be achieved for a few shots by the application of a suitable gun oil or lubricant to the gas rings 78, which may be delivered to the gas rings 78 through the gas ports 44 on the bolt carrier 38, but this is a very temporary solution, and the regular application of lube into the cylinder 40 becomes a prominent problem very shortly. The removal of the gas rings 78 is not without its own drawbacks. The original gas operating system was designed to control and capture all of the gas G that comes through the gas tap 88 on the bolt carrier 38, to be channeled through a portion of the bolt carrier 38 and vented through one or more gas ports 44.

Indeed, the removal of the gas rings 78 from existing bolts 12/pistons 30 leaves a large unfilled gap (gas ring groove 80) which progressively collects more fouling and debris and which is more difficult to clean. Additionally, removal of the gas rings 78 permits high-pressure gas G, which is full of gunpowder byproducts, to enter the outside of the operating system and into the trigger without impediment. Accordingly, this necessitates the more-frequent cleaning of the trigger and other internal components. However, the modification of the piston portion 30 of the bolt 12 and the associated removal of the friction problems from the gas rings 78 is a worthwhile endeavor if extreme accuracy is the objective.

Modifying a direct-impingement gas operating system to work without gas rings 78 is more than just simply removing the gas rings 78 from the bolt 12. Diameter measurement of a typical piston of an original bolt, with the gas rings removed, is 0.441 inches. The corresponding cylinder of the mated carrier measured 0.450 inches. It was found that the operating system failed to function when the gas rings were removed. Another solution is needed.

As explained above, the reason for the bolt modification and the ultimate elimination of the gas rings 78 came about as a quest to eliminate the regular, unpredictable vertical stringing exhibited by various rifles at 300, 600 and 1000 yards during rifle competitions. The vertical stringing exhibited is typically as high shots, i.e. high 9-ring, and was a problem identified in rifles chambered in .308 Winchester, 6 mm OMC and 6.5 Creedmoor. Various gunpowders were used in these rifles, e.g., Hodgdon's H4350 gunpowder which is a favored powder, but which is not as clean-burning as many other powders.

The goal was to make the rifle more capable keeping all shots fired at longer ranges, e.g., 600 yards, to fall within the 6-inch x-ring's vertical displacement, even if displaced left or right due to wind drift. If a rifle could maintain this mark, the potential for producing a higher score is much greater than with a rifle that is not capable of this performance.

Getting a self-loading, direct-impingement rifle to shoot reliably with the accuracy of 1 moa at 300, 600 yards and beyond can be broken down into three basic areas: build a rifle with high quality parts, load the best possible ammunition, and the shooter must do his part. The difficulties in building a truly accurate self-loading firearm are so great that bolt action rifles are still considered a better choice at longer distances. Practical experience with direct-impingement, semiautomatic match rifles at 600 yards typically results in one or two high nine's or some very high ten's during the 20 shots for record. This happened often enough during testing and evaluation, and in actual competitions, with the self-loading firearms, and did not happen with bolt-action rifles to lead to the conclusion that it was not the shooter. Since there was only high quality ammunition being used, and the winds were often calm, the rifle became the focus of the quest.

With the direct-impingement gas pressure systems, operation is similar to other AR-15/M-16-based rifles, in that the cycling of the action (operating system) starts once the bullet passes by the gas port (not shown) in the barrel 86. The gas pressure, i.e., high-pressure gas G, is delivered via a gas tube 92 to the enclosed area, i.e., sealed gas chamber 94, formed by the interface between the bolt 12 and bolt carrier 38, e.g., inside the rifle's upper receiver between the piston 30 of the bolt 12 and the cylinder 40 of the bolt carrier 38.

In the prior art, the sealed gas chamber 94 is defined by the bolt piston 30 with gas rings 78 on one side (forward) of the sealed gas chamber 94, and the bolt carrier's cylinder 40 on the other side of the sealed chamber 94. The shape of the aft bearing 32 of the bolt 12 provides a seal (with very little or no clearance) at the aft carrier bearing 48 of the bolt carrier 38 to limit gas pressure loss while still permitting the bolt 12 to move back and forth within the bolt carrier 38 while high-pressure gas G is present. The gas rings 78 of the bolt's piston 30 seal the other side of the sealed gas chamber 94 and allow the bolt 12 to rotate, such as when the bolt 12 is locked (in battery) and unlocked (out of battery) in the barrel extension 84. As the gas pressure G in the sealed gas chamber 94 forces the gas piston 30 and cylinder 40 apart, the bolt 12 cannot move forward into the sealed chamber 94, so the bolt carrier 38 must move to the rear, away from the barrel 86.

Once the bolt carrier 38 starts moving towards the rear, its kinetic energy provides enough inertia to travel the effective full distance to the rear, compressing the buffer/spring (not shown) enough to fully extract and eject the spent cartridge. During this time, the bolt 12 rotates slightly, according to the cam pin 54 in the bolt carrier's slot 56, and the bolt 12 unlocks from the barrel extension 84. The remaining gas pressure G is vented overboard via one or more exhaust ports 44 in the bolt carrier 38, the empty case is extracted and ejected, and finally the bolt carrier assembly 10 is stopped by the buffer/spring. The gas ports 44 may be oriented in any manner suitable to enhance the operation of the firearm. FIGS. 3 and 6-9 illustrate generally vertical orientation of the gas ports 44, while FIGS. 10-12 illustrate a horizontal arrangement. A single port or multiple ports may be used to achieve the desired gas pressure profile during operation of the firearm.

While this is in progress, and during the early stages of movement of the bolt carrier 38, just before the bolt 12 rotates out of battery, the bullet has almost reached the end of the barrel 86. This critical moment is when a binding or sticky bolt/carrier group 10 can affect the final amount of gas pressure pushing the bullet out of the barrel, and can also affect the resulting vibrations/harmonics of the barrel 86 and associated components. If the bolt carrier 38 is slow to unlock and move towards the rear, before the bolt 12 rotates out of battery, more pressure is temporarily retained in the barrel 86, possibly resulting in aberrant vibrations/harmonics, higher bullet velocity and a higher shot on the target. A bolt carrier group 10 that exhibits variable, inconsistent performance when it opens and in how it cycles will have an adverse effect on accuracy which is manifested at least in larger vertical displacement of some shots within the groups. A bolt carrier assembly 10 that is very consistent in opening and cycling the same way from shot-to-shot would provide the potential for smaller vertical groups on target, if the shooter does his part.

Thus the basic problem affecting the accuracy in these rifles is the inconsistency in the cycling of the bolt 12 and carrier 38, in particular as it unlocks and travels to the rear. Goals of this invention are to minimize the shot-to-shot variations in the cycling of the operating system and the carrier assembly 10, and to minimize the differences in velocities and the extreme spread (ES) in bullet speed of the ammunition from shot to shot to result in smaller groups, and in limited, superior vertical dispersion.

Development of the Operating System

Experience with an AR-10 rifle in 6 mm OMC revealed a large amount of powder fouling on the gas rings 44 at the end of the day of shooting, which was typically 88 rounds fired, and that noticeable additional effort was required to unlock or to cycle the action (operating system). During 50-round matches the effort to unlock the action was less, but was still there. It was hypothesized that fouling inside the bolt carrier assembly 10 might be the source of the vertical-stringing problem. There were simply too many high 9's that were neither the shooter nor the ammunition. The rifle was a known good performer in its unmodified state. Consistent scores in the mid-780's (out of 800) and even 495/500 and 792/800 were achieved with the rifle. The remaining functionality of the rifle was acceptable, and it fed ammo and ejected it properly and reliably.

Several attempts were made to solve the vertical stringing problem with different types of lubrication on the gas rings 44. When this did not work, the gas rings 44 were bent to a smaller diameter than the cylinder bore 40 of the bolt carrier 38 wherein the gas rings 44 were allowed to just fill the space (gas ring groove 80) on the bolt's piston 30. However, the modified gas rings 44 were not able to permit the reliable function of the operating system. Too much high-pressure gas G was able to escape without enough remaining to cycle the action. If the gas rings 44 were bent to a diameter that was too small, the rifle simply would not cycle reliably. If the gas rings 44 were too big, the original vertical stringing problem remained. What was wanted is a permanent solution to the problem of a sticky bolt carrier 38 seemingly caused by powder fouling regardless of the number of rounds fired during a rifle match. It seemed that the gas rings 78 should be removed, but reliable operation was not certain.

As determined earlier, the removal of the gas rings 78, with nothing more, did not result in reliable operation. That was evident from the test wherein the gas rings 44 were too small in diameter. The original piston 30 without the gas rings 44 would be still smaller. It is speculated that since 100% control of the high-pressure gas (G) was desired, according to the original design of the operating system, and that a solid piston 30 would be virtually impossible to fit to a cylinder 40 of the bolt carrier 38 to both control the gas G and to allow relative movement, the gas rings 44 were utilized. The use of the gas rings 78 permits the piston 30 to be machined significantly smaller than the cylinder 30 of the carrier 38, for ease of assembly. The gas rings 44 fill the gas ring groove 80 around the piston 30 and the piston/cylinder interface 70. Again, simply removing the gas rings 78 resulted in failure. The firearm would not function properly. Numerous modifications were attempted before a workable solution was found.

The solution is to remove the gas rings 44 entirely, and to weld the slot (gas ring groove 80) in the piston 30 where the gas rings 44 once were. When welding the gas rings' groove 80 the groove 80 would be filled with metal, and the diameter of the piston 30 would be enlarged slightly beyond the original radius/diameter. This leaves the piston 30 slightly too large to fit inside the cylinder 40 The piston 30 was then machined/turned so that it would barely slip fit inside the bolt carrier 38. Of course, subsequent bolts 12 may be made to the inventive dimensions without ever including the gas ring groove 80 and forming the piston 30 to the correct diameter with respect to the cylinder 40.

Reassembly of the bolt carrier group 10 revealed little if any frictional resistance at all. There are now only two points of contact, at the aft carrier bearing 48 and the cylinder 40. In an assembled bolt carrier group 10, the bolt 12 is typically able to move from one end of the cylinder 40 to the other end under its own weight.

When a smaller rubber hose was inserted into the gas key (gas tap 88) and the gas ports 44 were plugged, the bolt 12 could be made to move easily back and forth using low vacuum and positive pressure through the rubber hose.

Through testing, it was determined that a gap 68 of between 1 ten thousandths of an inch was a good gap 68 to use at the piston cylinder interface 70, depending on the individual characteristics of the firearm and the ammunition. To be clear, a gap of 0.001 inch is a 0.001 inch gap all the way around the piston 30.

The first bolt modified was from an AR-10 rifle in .308 Winchester. The rifle was basically a stock 24-inch Panther model from DPMS. Other than adding a match hand guard, a two-stage trigger and sights, it was basically a stock rifle from DPMS. A modified bolt 12 and matching carrier 38 were assembled into a carrier assembly 10 and inserted into the upper receiver 72 of the rifle. The action operated so smoothly that when the muzzle was moved slightly upward or downward, the bolt 12 and carrier 38 would lock or unlock under their own weight. I assembled the upper receiver 72 onto a lower receiver (including a trigger) and proceeded to cycle five dummy rounds through the rifle. There was no binding. Next, the rifle was function-fired with 10 rounds. The rifle fired just fine and the bolt carrier group 10 locked to the rear each time. The bolt 12 was inspected to view the bolt's newly-machined area at the piston 30, and the cylinder bore 40 inside the bolt carrier 38. No defects or damage were found.

The rifle was then used in an 80-round match, for a total of 88 rounds fired, with eight sighter shots included. The results with the modified bolt piston 30 were very encouraging, with a 786-28× (out of 800/80× possible) and with a 200-8× (out of 200/20× possible) at 600 yds. No vertical stringing characteristics were observed. Throughout the day the freedom of movement of the bolt 12 and carrier 38 were checked and reevaluated. Each time it was found that it would still open and close under its own weight even after firing 88 rounds for the day. The rifle functioned reliably in feeding, extracting, and ejecting, and the bolt carrier 38 would lock back after the final shot from a magazine.

Using a chronograph, a short test was conducted with the .308 Winchester AR-10 rifle to see if any differences might be observed between bolt carrier assemblies 10 both with and without gas rings 44. A bolt carrier assembly 10 with gas rings 44 and having correct headspace for the chamber was used in the test. The test began with a perfectly cleaned bolt 12 and bolt carrier 38 which were lubricated along with the bolt cam pin 54 with some CLP lubricant on the gas rings 44. After 60 rounds were fired, two 10-shot strings were chronographed with ammunition loaded for 600 yards. The test was repeated with the modified ringless (no gas rings 78) bolt 12. After firing 60 rounds, two 10-shot strings were also chronographed with the same lot of 600-yard ammunition.

Comparing the two ten-shot strings showed that in all categories the differences in spread between the two ten-shot strings, i.e., Average velocity, High velocity, Low velocity, Extreme Spread between the High and Low velocities (ES), Standard Deviation (SD), showed that the ammunition tested with the modified, ringless bolt 12 was more consistent in every category.

After the test was over, the rifle was fired at 600 yds for an additional 22 rounds and scored a 200-9×. Again the bolt 12 and carrier 38 were checked for freedom of movement. It would still open and close under its own weight after 100 rounds were fired.

So far, the only consequence noted for the ringless bolt 12 and carrier 38 is the new presence of powder residue from gas leakage on the piston 30 where the gas rings 44 used to be, and a fine film of powder residue forward of that area. This did not seem to affect the accuracy performance of the firearm to any perceptible degree. No abnormal wear has been found inside the bolt carrier 38 or on the newly-machined surface of the piston 30 where the gas rings 44 used to be.

An AR-15 bolt carrier assembly 10 was modified as well. It was test-fired with a variety of 5.56 mm NATO and .223 Remington ammunition, including 55-grain ball, 69-grain Federal® Match, Black Hills® 77-grain and 80-grain match ammunition, and LC 77-grain LR ammunition as well. The rifle functioned fine with all types of ammo.

FIGS. 10A-12B illustrate various embodiments of the claimed gas operating system. The inventive direct-impingement gas operating system includes the same components and arrangement described above, except for those features and elements described below.

Figure 10A:
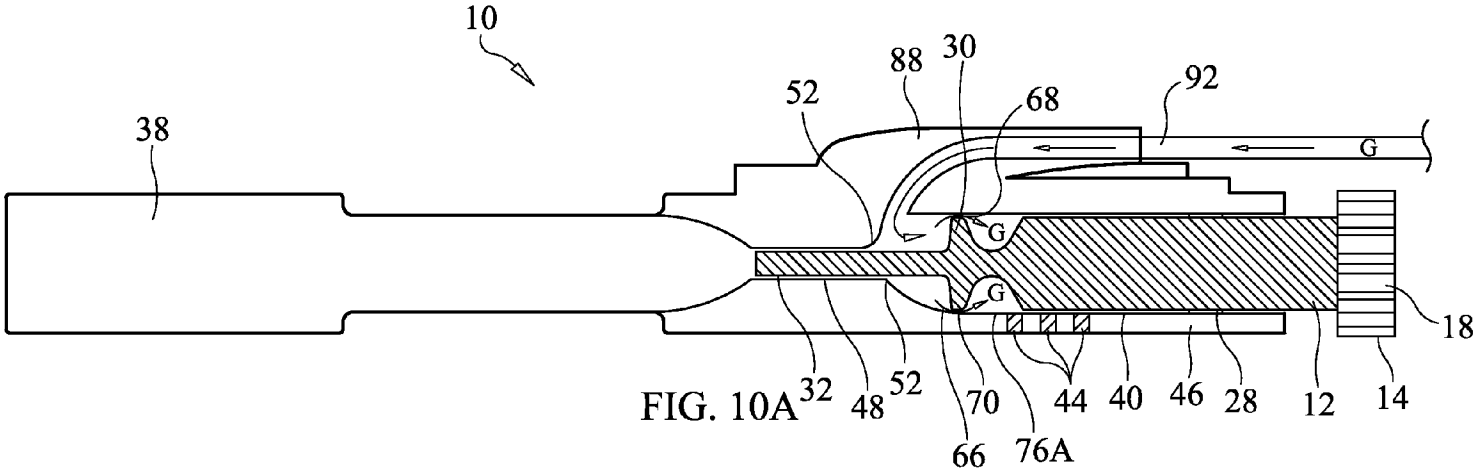
FIGS. 10A-10B illustrate sectional views of a firearm bolt and bolt carrier in a battery orientation and out of battery, respectively, according to an embodiment of the present invention.
Figure 10B:
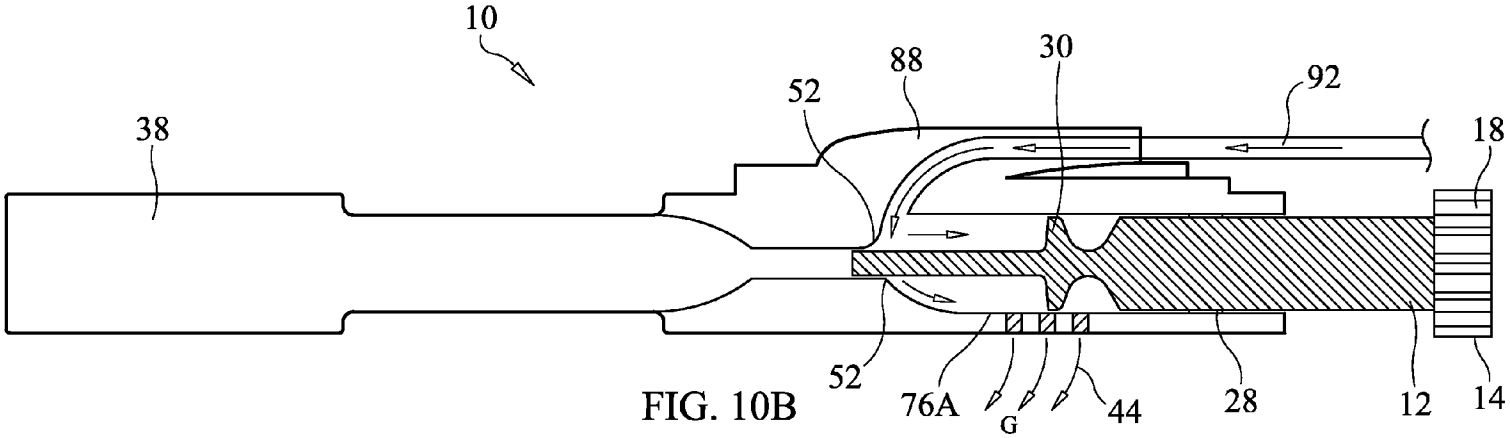

FIG. 10A-10B illustrate a bolt carrier assembly 10 which includes a bolt carrier 38 having a cylinder 40 which is generally of uniform diameter. That portion of the cylinder 40 at the forward end 42 of the carrier 38 provides a bearing surface to complement the forward bolt bearing 28.

One or more gas ports 44 are located in the wall 46 of the carrier 38 and extend into the cylinder 40 to vent gunpowder combustion gases G away from the internal mechanisms of the operating system and trigger (not shown). The gas ports 44 are illustrated at the bottom of the carrier 38 in FIGS. 9A-12B for clarity only. In reality it is preferred to place the gas ports 44 to one side of the carrier 38 or the other, corresponding to the placement of the loading and ejector port (not shown).

A vented gas chamber 66 (see FIG. 10A, 11A, 12A) is formed in the cylinder 40 between the piston 30 of the bolt body 12 and the point of communication 52. The vented gas chamber 66 is sealed because the high-pressure gases G from the combustion of gunpowder have are not prevented from exiting the sealed gas chamber 66, even before any work is done with the high pressure gases G.

The carrier 38 must be moved relative to the piston 30 of the bolt 12 (see FIGS. 10B, 11B, 12B) in order to bring the operating system into an out-of-battery condition, and to more-rapidly release the gases G. However, the piston 30 is not sealed against the cylinder 40 with one or more gas rings 78. Contrary to the prior art, there is no gas ring groove 80 around the piston 30 and there are no gas rings 78. Instead, the piston 30 travels close to, but does not touch, the cylinder 40. A gap 68 is formed between the piston 30 and the cylinder 40. The key here is to make the gap 68 small enough to ensure the consistent and reliable functioning of the operating system, but big enough to eliminate any friction or drag between the piston 30 and the cylinder 40 when they are fouled or dirty.

Additional features may be included according to the inventive arrangements. FIGS. 10A-10B illustrate a generally uniformly, untapered cylinder 40 (also shown as zero-taper cylinder 76A) and a piston 30 which is sized to provide a uniform gap 68 throughout the movement range of the piston 30 relative to the cylinder 40. Other configurations may also be used to provide distinct advantages.

Figure 11A:
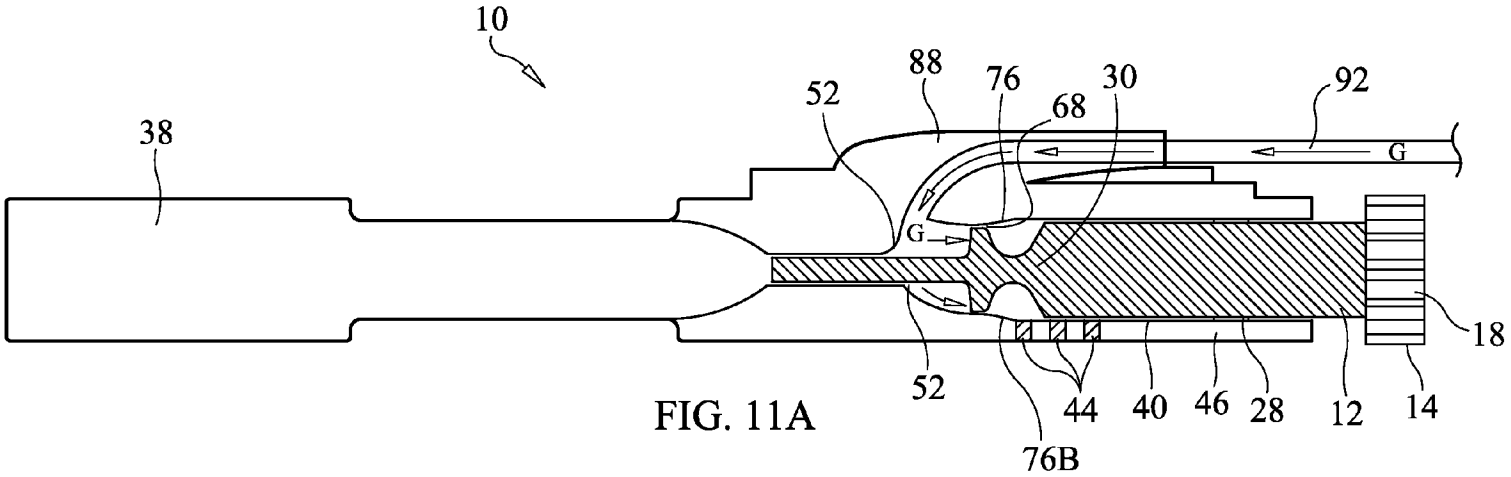
FIGS. 11A-11B illustrate sectional views of a firearm bolt and bolt carrier in a battery orientation and out-of-battery orientation, respectively, according to an embodiment of the present invention.
Figure 11B:
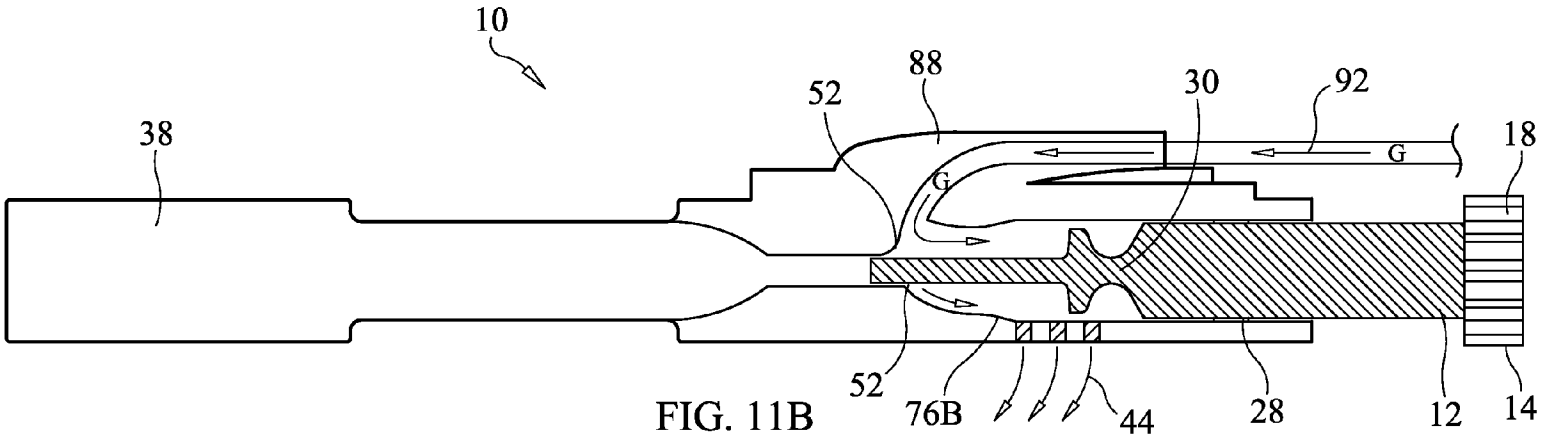

FIGS. 11A-11B illustrate a cylinder 40 having a tapered portion 76B with a straight-tapered profile. That is, the tapered portion 76B of the cylinder 40 exhibits a linear taper. There are at least two ways to achieve this configuration. First, the diameter of the cylinder 40 at the gap 68 or piston/cylinder interface 70 may be reduced, and the piston 30 may be reduced a corresponding amount. Accordingly, away from the tapered portion 76B, the cylinder 40 and the forward bolt bearing 28 may have their original dimensions. Second, the cylinder 40 away from the tapered portion 76B (and the forward bolt bearing 28) may be enlarged slightly, while leaving the piston 30 and the gap 68 at the piston/cylinder interface 70 at the dimensional configuration illustrated in FIGS. 10A-10B.

The straight-tapered portion 76B of the cylinder 40 permits the high-pressure gas G to be released around the piston 30 even more quickly than the vented chamber 66 of FIGS. 10A-10B.

Figure 12A:
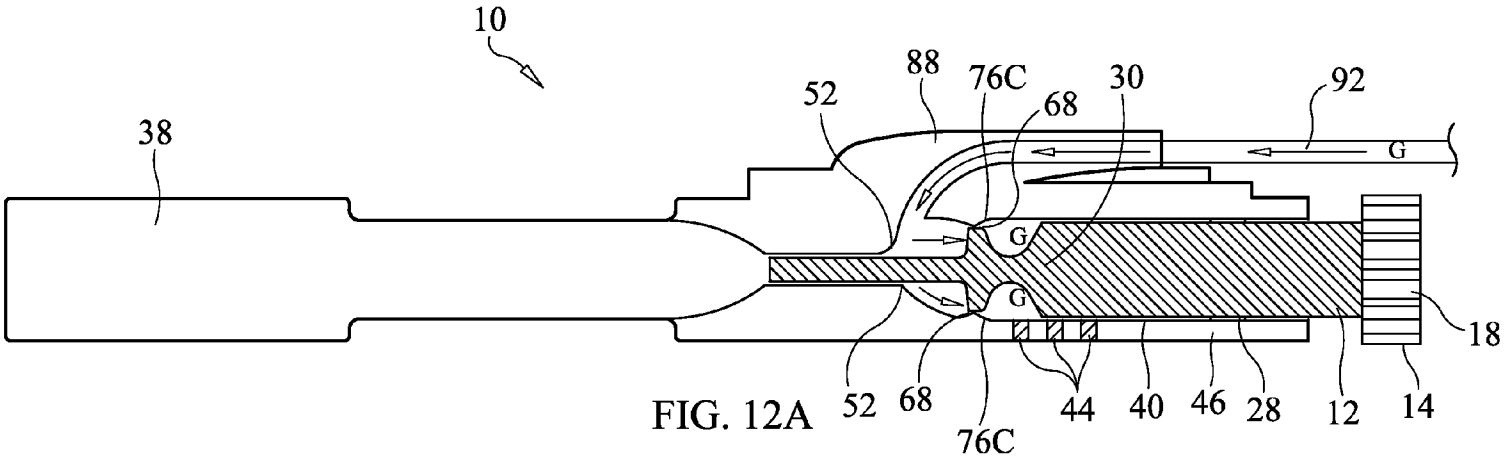
FIGS. 12A-12B illustrate sectional views of a firearm bolt and bolt carrier in a battery orientation and out of battery, respectively, according to an embodiment of the present invention.
Figure 12B:
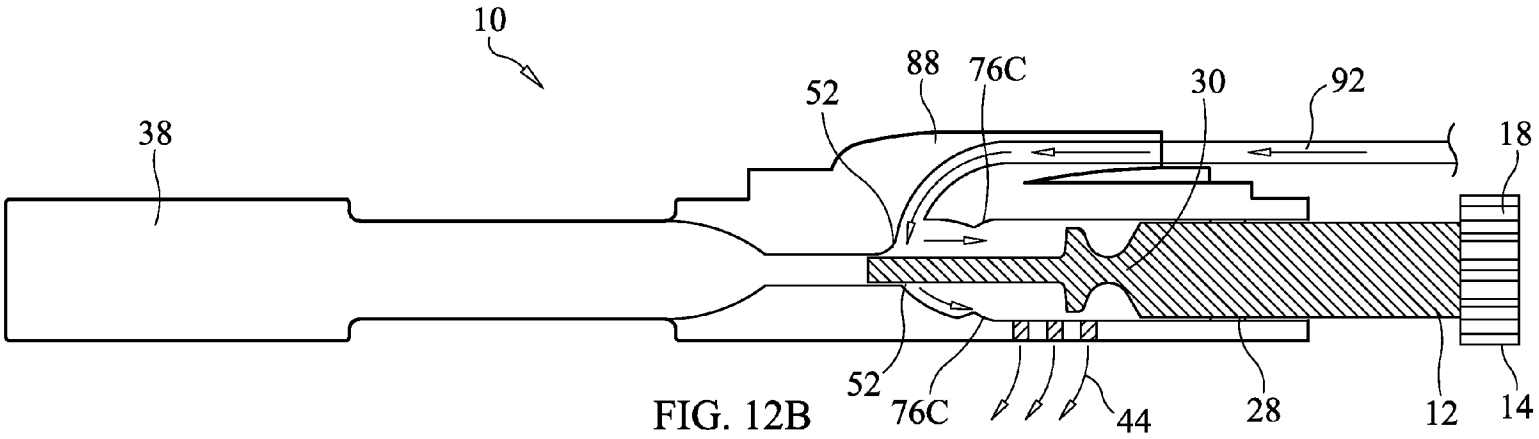

FIGS. 12A-12B illustrate a cylinder 40 having a tapered portion 76C with a non-straight-tapered profile. That is, the tapered portion 76C of the cylinder 40 exhibits a non-linear taper, such as a parabolic, elliptical or other curved configuration. Like the embodiment of FIGS. 11A-11B, there are at least two ways to achieve this configuration. First, the diameter of the cylinder 40 at the gap 68 or piston/cylinder interface 70 may be reduced, and the piston 30 may be reduced a corresponding amount. Accordingly, away from the tapered portion 76C, the cylinder 40 and the forward bolt bearing 28 may have their original dimensions. Second, the cylinder 40 away from the tapered portion 76C (and the forward bolt bearing 28) may be enlarged slightly, while leaving the piston 30 and the gap 68 at the piston/cylinder interface 70 at the dimensional configuration illustrated in FIGS. 10A-10B.

The non-straight-tapered portion 76C of the cylinder 40 permits the high-pressure gas G to be released around the piston 30 even more quickly than the vented chamber 66 of FIGS. 10A-11B.

Each of these embodiments of FIGS. 10A-12B provide distinct advantages. In addition to the very significant reduction in friction between the piston 30 and the cylinder 40 from the removal of the gas rings 78, especially when dirty/fouled, the gap 68 at the piston/cylinder interface 70 allows for an increase in the pressure and/or volume of the high-pressure gas G through the system. This is possible due to the vented chamber 66 arrangement which does not trap the high-pressure gases G rigidly, but instead provides a permanent escape route.

Accordingly, ammunition having non-standard pressure curves may be used, such as gunpowder having a slower burning rate or heavier bullets than standard. Both the slower-burning powder and the heavier bullets will delay or extend the pressure curve and directly affect the amount of pressure in the barrel 86 at the gas block 90, which translates directly into correspondingly-higher pressures throughout the operating system.

The non-tapered 76A cylinder 40 of FIGS. 10A-10B provides some ability to accommodate higher pressure impulses. The straight/linear tapered 76B cylinder 40 provides a capacity increase over the non-tapered 76A, while the non-linear-tapered 76C cylinder provides the most capacity for releasing the high-pressure gas G quickly. This in turn helps to protect the operating system from excessive pressure conditions.

The straight/linear tapered 76B cylinder 40 of FIGS. 11A-11B exhibits an appropriate gap 68 at the piston/cylinder interface 70 when the system is in battery. That is, when the bolt lugs 18 are locked in position with the complementary lugs of the barrel 86 or barrel extension 84. However, as the high-pressure gas G forces the carrier 38 to move relative to the bolt 12, the piston 30 moves relative to the cylinder and the gap 68 grows according to the straight/linear taper 76B. Depending on the exact taper selected, the rate of growth of the gap may be very rapid, which contributes to the rapid release of high pressure gas G out of the system.

The non-straight-tapered 76C cylinder 40 of FIGS. 12A-12B exhibits an appropriate gap 68 at the piston/cylinder interface 70 when the system is in battery. That is, when the bolt lugs 18 are locked in position with the complementary lugs of the barrel 86 or barrel extension 84. However, as the high-pressure gas G forces the carrier 38 to move relative to the bolt 12, the piston 30 moves relative to the cylinder and the gap 68 grows according to the non-straight-taper 76C. Depending on the exact taper selected, the rate of growth of the gap may be very rapid, even more rapid than the straight/linear taper 76B, which contributes to the very rapid release of high pressure gas G out of the system.

Each of these embodiments may be combined with the adjustable gas block 90 to limit the amount of high pressure gas G delivered to the bolt carrier assembly 10 through the gas tube 92. In this manner, a tremendous variety of bullets and gunpowders may be selected and implemented successfully without introducing excessive pressure conditions into the operating system.

From observations and testing, the removal of the gas rings 44 and the corresponding modification of the bolt 12 and piston 30 offers a great improvement in accuracy of the AR-10/15 rifles over rifles with gas rings. This technology has a very practical application in the military environment, wherein the use of modified bolts/carriers on the M-110 Semi Auto Sniper rifle, for example, would be a benefit for our troops who would be shooting at small targets at longer ranges. The ringless bolt/carrier would ensure a higher level of accuracy regardless of the number of rounds fired, within reason.

What is claimed is:

1. A firearm operating system for self-loading firearms comprising:

a generally cylindrical bolt body inside a bolt carrier, including a forward bearing arranged around the bolt body aft of the bolt head;

a piston portion arranged around the bolt body aft of the forward bearing, the piston portion having no piston rings;

an aft bolt bearing arranged around the bolt body aft of the piston portion and at an aft end of the bolt body;

wherein the bolt carrier slidingly receives the bolt body in a longitudinally-oriented cylinder in the bolt carrier, the cylinder extending from a forward end of the bolt carrier into the bolt carrier a predetermined distance;

a gas port on the exterior of the bolt carrier and in fluid communication with the cylinder interior to the bolt carrier through a wall of the bolt carrier;

a tubular aft carrier bearing section oriented longitudinally in the bolt carrier and extending from an aft end of the bolt carrier a predetermined distance into the bolt carrier to a point of communication with the cylinder, wherein the bolt body is slidingly captured in the cylinder of the bolt carrier and borne on the two bearings of the bolt body, wherein the forward bearing of the bolt body is borne on the cylinder of the bolt carrier, wherein the aft bearing of the bolt body is borne on the aft carrier bearing of the bolt carrier, wherein the piston portion of the bolt coacts with the cylinder of the bolt carrier to form a vented chamber which is in gas communication with the gas port, wherein a gap is formed between the piston portion and the cylinder wherein the piston and the cylinder do not contact and drag at the piston/cylinder interface is eliminated.

2. The firearm operating system for self-loading firearms of claim 1, wherein the bolt carrier is slidingly mounted in a firearm receiver.

3. The firearm operating system for self-loading firearms of claim 2, wherein the bolt carrier is slidingly mounted in an upper firearm receiver.

4. The firearm operating system for self-loading firearms of claim 1, wherein when the bolt is in battery the gap between the piston and the cylinder is 1 ten thousandth of an inch (0.00254 mm).

5. The firearm operating system for self-loading firearms of claim 1, wherein when the bolt is in battery the gap between the piston and the cylinder is 1-5 ten thousandths of an inch (0.00254 mm-0.0127 mm).

6. The firearm operating system for self-loading firearms of claim 1, wherein when the bolt is in battery the gap between the piston and the cylinder is 1 thousandth of an inch (0.0254 mm).

7. The firearm operating system for self-loading firearms of claim 1, wherein the gap between the piston and the cylinder is 1-3 thousandths of an inch (0.0254 mm-0.0762 mm).

8. The firearm operating system for self-loading firearms of claim 1, wherein the gap between the piston and the cylinder is 3-5 thousandths of an inch (0.0762 mm-0.127 mm).

9. The firearm operating system for self-loading firearms of claim 1, wherein the gap between the piston and the cylinder is 1-5 thousandths of an inch (0.0254 mm-0.127 mm).

10. The firearm operating system for self-loading firearms of claim 1, wherein the forward bearing of the bolt body is a continuous ring arranged generally perpendicular to the longitudinal axis of the bolt.

11. The firearm operating system for self-loading firearms of claim 1, wherein the forward bearing of the bolt body is a segmented ring arranged generally perpendicular to the longitudinal axis of the bolt.

12. The firearm operating system for self-loading firearms of claim 1, wherein the aft bearing of the bolt body is a cylindrical tube.

13. The firearm operating system for self-loading firearms of claim 1, wherein upon the introduction of gas into the chamber, the piston and the cylinder are urged to move relative to each other wherein the chamber is expanded and the piston is displaced to a position adjacent a gas release port in the wall of the bolt carrier wherein the gas is released.

14. The firearm operating system for self-loading firearms of claim 1, wherein forward bearing and the aft bearing of the bolt body engage the corresponding bearing portions of the bolt carrier in a sliding fit without discernible axial play.

15. The firearm operating system for self-loading firearms of claim 12, wherein the axial play is less than a half of a thousandth of an inch (0.0127 mm).

16. The firearm operating system for self-loading firearms of claim 1, wherein fore and aft reciprocating motion of the bolt body in the carrier on their respective bearings prevents significant accumulation of fouling on the bearing surfaces.

17. The firearm operating system for self-loading firearms of claim 1, wherein the cylinder includes a straight, non-tapered arrangement, wherein the gap between the piston and the cylinder is generally uniform as the vented gas chamber expands.

18. The firearm operating system for self-loading firearms of claim 1, wherein the cylinder includes a tapered frustoconical profile, wherein the gap between the piston and the cylinder is enlarged linearly as the vented gas chamber expands.

19. The firearm operating system for self-loading firearms of claim 1, wherein the cylinder includes a non-linear-tapered profile, wherein the gap between the piston and the cylinder is enlarged non-linearly as the vented gas chamber expands.

20. The firearm operating system for self-loading firearms of claim 1, wherein the cylinder includes one of a tapered frustoconical shape, a parabolic tapered shape and an elliptical tapered shape, wherein the tapered portion of the cylinder is between the aft bearing of the bolt carrier and the gas port of the bolt carrier.

* * * * *